US006466680B1

(12) United States Patent
Gelow et al.

(10) Patent No.: US 6,466,680 B1
(45) Date of Patent: Oct. 15, 2002

(54) HIGH-FREQUENCY LOUDSPEAKER MODULE FOR CINEMA SCREEN

(75) Inventors: William J. Gelow, Thousand Oaks; Bernard M. Werner, Los Angeles, both of CA (US)

(73) Assignee: Harman International Industries, Inc., Northridge, CA (US)

( * ) Notice: Subject to any disclaimer, the term of this patent is extended or adjusted under 35 U.S.C. 154(b) by 211 days.

(21) Appl. No.: 09/605,279

(22) Filed: Jun. 28, 2000

Related U.S. Application Data

(60) Provisional application No. 60/160,254, filed on Oct. 19, 1999.

(51) Int. Cl.[7] ..... H04R 1/02; H04R 1/20

(52) U.S. Cl. ..... 381/340; 381/339; 381/98; 181/152; 181/177

(58) Field of Search ..... 381/98, 99, 336, 381/337, 338, 339, 340, 341, 342, 343, 163, 286, FOR 140, FOR 141, FOR 142, FOR 143, 150; 181/148, 152, 153, 175, 177, 179, 192

(56) References Cited

U.S. PATENT DOCUMENTS 4,469,921 A * 9/1984 Kinoshita ..... 381/340
4,893,695 A * 1/1990 Tamura et al. ..... 381/340
4,922,541 A * 5/1990 Walker ..... 381/340
5,233,136 A * 8/1993 Hamada ..... 181/152
5,526,456 A * 6/1996 Heinz ..... 381/340
5,875,252 A * 2/1999 Lasage ..... 381/340
5,878,148 A * 3/1999 Alexandrov ..... 381/340
5,925,856 A * 7/1999 Meyer et al. ..... 181/152
6,028,947 A * 2/2000 Faraone et al. ..... 381/340
6,055,320 A * 4/2000 Wiener et al. ..... 381/343
6,059,069 A * 5/2000 Hughes, II ..... 381/340
6,094,495 A * 7/2000 Rocha ..... 381/343
6,320,970 B1 * 11/2001 Czerwinski et al. ..... 381/343
6,343,133 B1 * 1/2002 Adamson ..... 381/343

* cited by examiner

*Primary Examiner*—Xu Mei
(74) *Attorney, Agent, or Firm*—Sonnenschein Nath & Rosenthal

(57) ABSTRACT

A high-frequency cinema loudspeaker module for deployment behind a perforated cinema screen is configured with a waveguide to compensate for the beam-spreading effects of the perforated screen at the high end of the frequency range and to facilitate and co-ordinate integration with a complementary midrange module of a total sound system in providing defined coverage in a theater. A compression driver is coupled to a waveguide that is specially shaped to narrow the horizontal beamwidth at the higher frequencies affected by the perforated screen, and thus provide compensation that results in a more uniform overall defined sound coverage in the theater within the designated high-frequency range. The module is configured with the driver and waveguide axes inclined downwardly at an angle of 6 degrees from horizontal to facilitate overall coverage.

6 Claims, 8 Drawing Sheets

| | |
|---|---|
| Waveguide length = k | (Depth of Wave guide) |
| Throat offset = d | (Adjust until sidewall tangent) |
| Throat radious =a | (exit diameter) |
| Target horz. coverage = $\theta_1$ | (1/2 angle) |
| Target vert. coverage = $\theta_2$ | (1/2 angle) |

$$\theta_0 = Tan^{-1}\left(\left[(Tan\theta_1)(Tan\theta_2)^{1/2}\right]\right)$$

$$\alpha = \frac{Tan\theta_1}{Tan\theta_2}$$

$$r(x) = a^2 + (Tan^2\theta_0)(x^2)$$

$$b(x) = r(x)\left[1 + \frac{(\alpha-1)(x-d)}{R}\right]^{-1/2}$$

$$c(x) = r(x)\left[1 + \frac{(\alpha-1)(x-d)}{R}\right]^{-1/2}$$

Curve that define wall section views as a function of axial position "X".

$$\underset{\rightarrow}{b} = \begin{bmatrix} b(x) \\ 0 \end{bmatrix} \longleftarrow \text{horz. section}$$

$$\underset{\rightarrow}{c} = \begin{bmatrix} 0 \\ c(x) \end{bmatrix} \longleftarrow \text{vert. section}$$

$$\underset{\rightarrow}{d} = \left(\frac{r-x}{r}+1\right)^{1/2}\begin{bmatrix} b(x) \\ c(x) \end{bmatrix} \longleftarrow \text{diagonal section}$$

Where $\underset{\rightarrow}{b} = \underset{\rightarrow}{b}(y,z)$
$\underset{\rightarrow}{c} = \underset{\rightarrow}{c}(y,z)$
$\underset{\rightarrow}{d} = \underset{\rightarrow}{c}(y,z)$

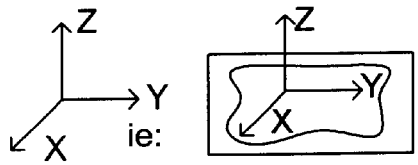

*FIG. 10*

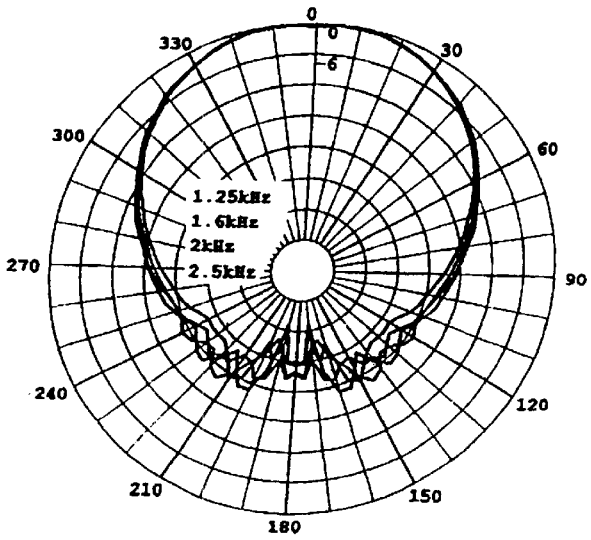
FIG. 11A
FIG. 11B
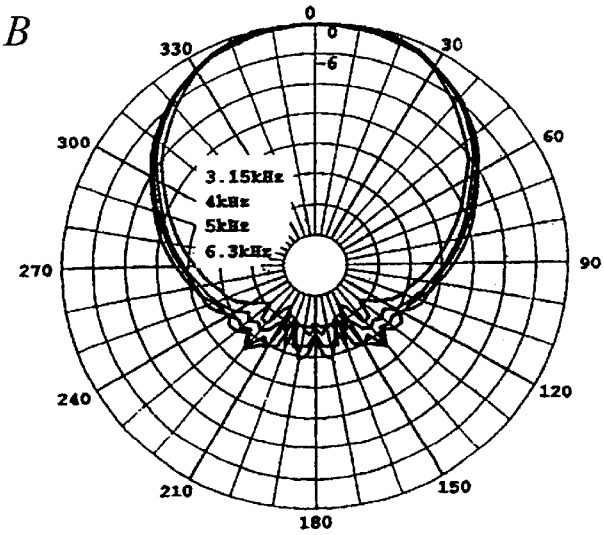
FIG. 11C
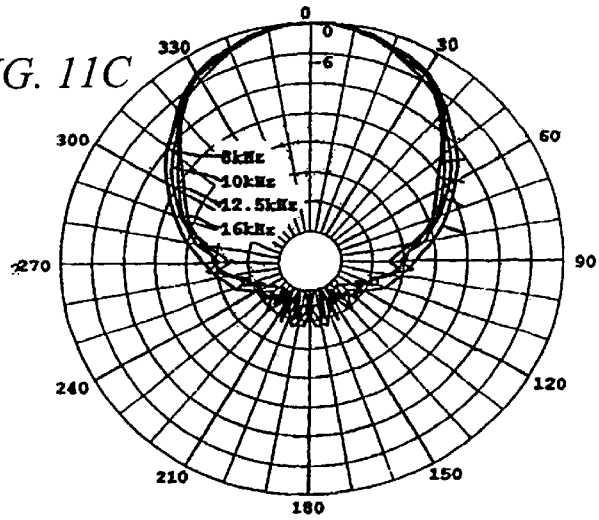

-6 dB VERTICAL DIRECTIVITY

HIGH-FREQUENCY LOUDSPEAKER MODULE FOR CINEMA SCREEN

PRIORITY

Benefit is claimed under 35 U.S.C. §119(e) of pending provisional application 60/160,254 filed Oct. 19, 1999.

FIELD OF THE INVENTION

The present invention relates to the field of cinema sound systems and more particularly it relates to structure of a compression-driven high-frequency loudspeaker module with improved waveguide structure and beamwidth compensation for deployment behind a perforated cinema screen.

BACKGROUND OF THE INVENTION

In general, in a cinema loudspeaker system the object and the challenge to designers is to provide uniform coverage as perceived at all seating locations in the theater with regard to both loudness and flatness of frequency response, while causing the perceived sound source to coincide acceptably with the images projected on the screen.

A total screen array may utilize two or more speaker systems, typically "stacks", located side-by-side (e.g. left, center and right); each of the stacks may be a three-way full frequency range unit having high-frequency, midrange and woofer portions. Typically, three multi-channel side-by-side arrays (left, center and right) each receive a unique directional signal with the object of recreating a left-to-right "sound stage" as accurately as possible

DISCUSSION OF RELATED KNOWN ART

FIG. 1 is graph showing a typical horizontal directivity index for a high quality conventional cinema high-frequency horn speaker as measured in free space, with no screen present. The curve shown depicts the target requirement that the frequency response of the directivity index should be held essentially flat over the high-frequency range (500 Hz–15 kHz). Directivity index expresses the gain (10 dB) in the peak direction on-axis, referred to an omnidirectional source having the same radiated power. and implies a corresponding beamwidth.

FIG. 2 is a graph showing the corresponding target value of 100 for horizontal beamwith measured at −6 dB relative to the on-axis peak, as being 100 degrees total i.e +/−50 degrees from the axis. As in FIG. 1 for directivity, the objective is to hold the beamwidth constant over the frequency range.

Typically for cinema loudspeakers the vertical directivity pattern is made even more directional for coverage and efficiency: typical beamwidths are about 90 to 100 degrees horizontal by about 40 to 60 degrees vertical.

Traditionally cinema loudspeakers have been designed and developed to approach the target requirements shown in FIGS. 1 and 2 as nearly as possible, when tested alone without any intervening cinema screen present.

The majority of motion picture exhibitors locate the loudspeaker system behind a perforated vinyl screen in order to preserve accuracy of sound sourcing. The small diameter holes and resulting low ratio of open area combine to affect sound propagation.

In the graphs of FIGS. 3 and 4 the curves shown represent the frequency response of the directivity index and the beamwidth of a conventional cinema high-frequency loudspeaker originally designed and developed to perform as shown in FIGS. 1 and 2, when the loudspeaker is deployed behind a perforated screen. In FIG. 3, at high frequencies above about a few kHz the directivity index reduces with increasing frequency up to about 10 Khz, where it has dropped from 10 dB to about 6 dB, representing a substantial loss of sound level (4 dB). The corresponding beamwidth, shown in FIG. 4, increases due to the spreading caused by the cinema screen to about 140 degrees at 8 kHz and about 190 degrees at 16 kHz, compared to the target value of 100 degrees.

These primary changes due to the screen affect the actual performance as a loss of high-frequency sound level for most or all of the audience as excessive spreading of the high-frequency coverage pattern wastes sound energy in unwanted directions and regions, e.g. the theater side walls where it is dissipated as a combination of unwanted reflection and/or absorption.

This effect of the screen spreading the high frequencies has been observed as a shortcoming in evaluating and analyzing theater sound installations. It can sometimes be alleviated by adjusting the equalization for more power at the high frequencies, however often the amount of addition power is unavailable, so that in general this effect has remained an unsolved problem in the field of cinema sound systems and loudspeakers of known art.

OBJECTS OF THE INVENTION

It is a primary object of the present invention, in the design of a high-frequency loudspeaker for deployment behind a perforated cinema screen, to provide compensation for the effects of the screen perforations that decrease the sound pressure level and that spread the coverage pattern at the high-frequency end of the audio frequency spectrum.

It is a further object to accomplish defined coverage for all high frequencies with the loudspeaker deployed behind the screen.

It is still further object to provide a high-frequency cinema loudspeaker that is compensated for deployment behind a screen and that can be readily integrated in an array with a midrange portion of a cinema sound system.

SUMMARY OF THE INVENTION

The abovementioned objects have been accomplished in the present invention of a high-frequency cinema loudspeaker that is configured with a waveguide to compensate for the beam-spreading effects of a perforated cinema screen at the high end of the frequency range and to facilitate and coordinate integration with the other elements of a total sound system in providing defined coverage in a theater.

The specially shaped waveguide provides uniform sound directivity for high frequencies into the audience area by narrowing the horizontal coverage at the higher frequencies affected by the screen. The waveguide shape also provides an asymmetric dispersion pattern in the vertical plane to project the main axis of energy downwardly by an angle that is selected to optimize audience coverage.

BRIEF DESCRIPTION OF THE DRAWINGS

The above and further objects, features and advantages of the present invention will be more fully understood from the following description taken with the accompanying drawings in which:

FIG. 10 shows the mathematical basis of the waveguide wall shape configuration.

FIGS. 11A–C are polar graphs showing the horizontal directivity of the high-frequency loudspeaker embodiment of the present invention as in FIGS. 5 and 6, measured at 12 frequencies ranging from 1.25 kHz to 16 KHz.

DETAILED DESCRIPTION

FIGS. 1–4 have been described above in connection with conventional high-frequency cinema loudspeakers of known art. Typically such speakers are compression-driven horn type speakers configured with inside surface contours that are symmetrical about a central axis in both the vertical and horizontal plane, and with cross sectional area that increases along the central axis in a predetermined manner.

Figure 1:
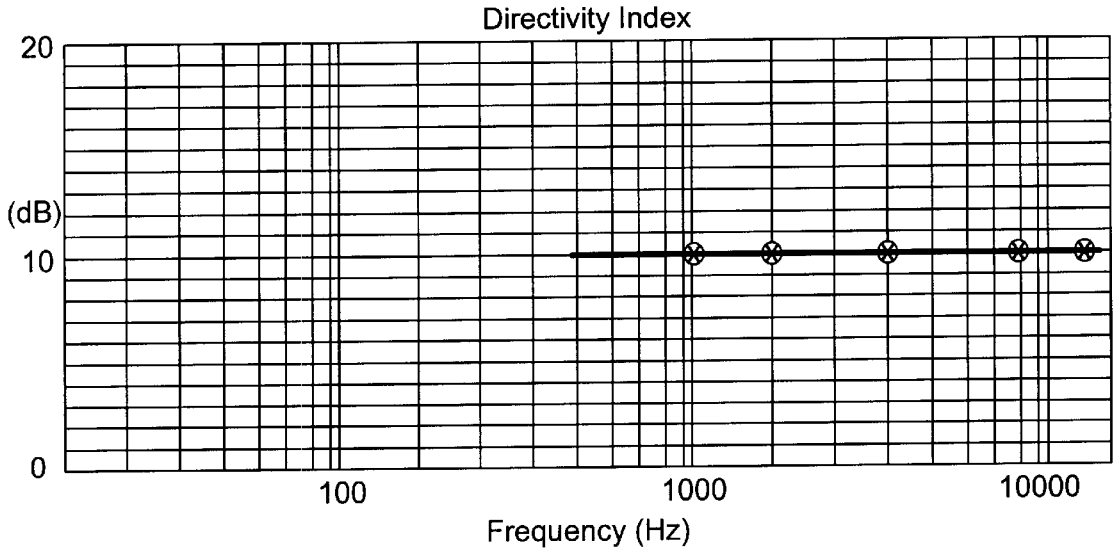
FIG. 1 PRIOR ART
FIG. 1 is graph showing the target flat frequency response of the horizontal directivity index of a conventional high-frequency cinema loudspeaker, with no screen present.
Figure 2:
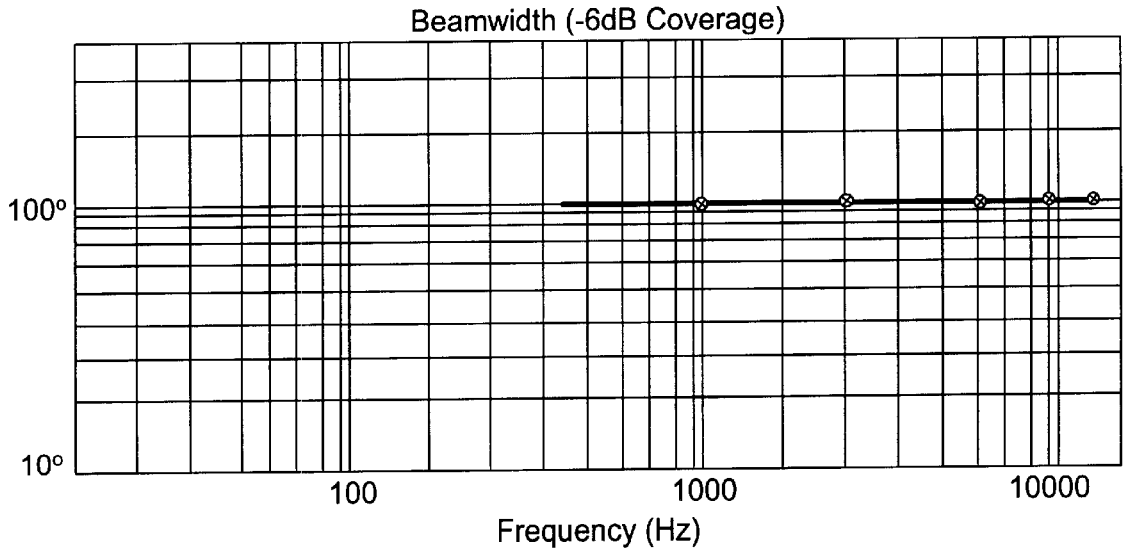
FIG. 2 is a graph showing the flat frequency response of horizontal −6 dB beamwidth coverage of the loudspeaker of FIG. 1.
Figure 3:
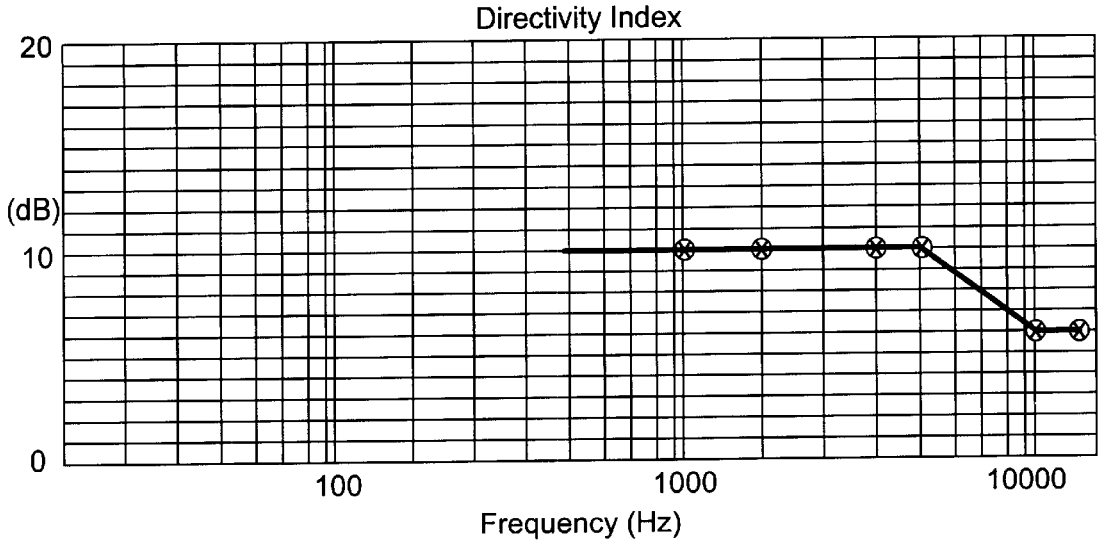
FIG. 3 PRIOR ART
FIG. 3 is a graph showing typical frequency response of horizontal directivity index for a conventional high-frequency cinema loudspeaker as in FIGS. 1 and 2 when it is deployed behind a perforated cinema screen.
Figure 4:
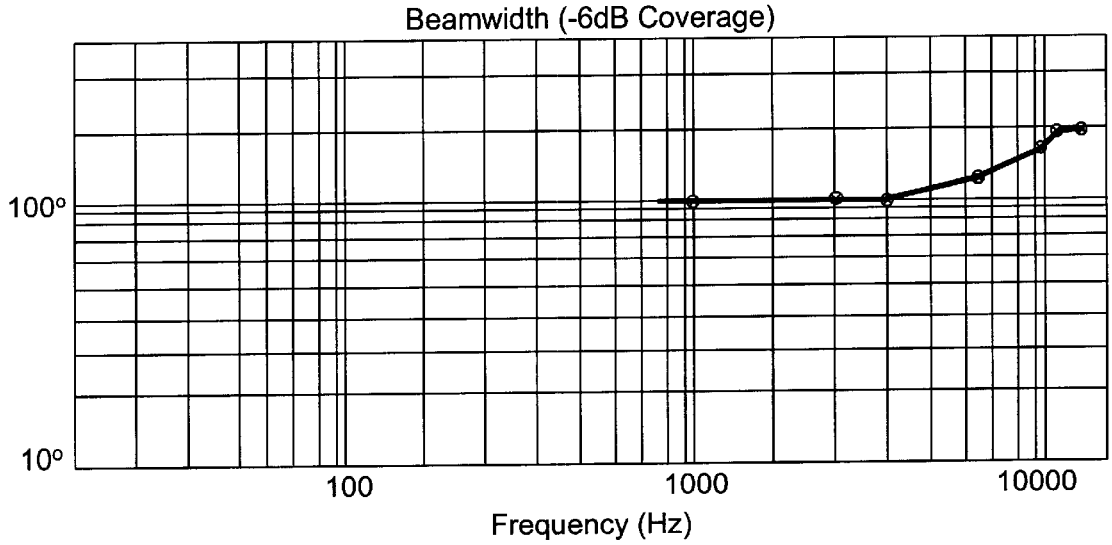
FIG. 4 is a graph showing the frequency response of horizontal −6 dB beamwidth coverage relating to the graph of FIG. 3.
Figure 5:
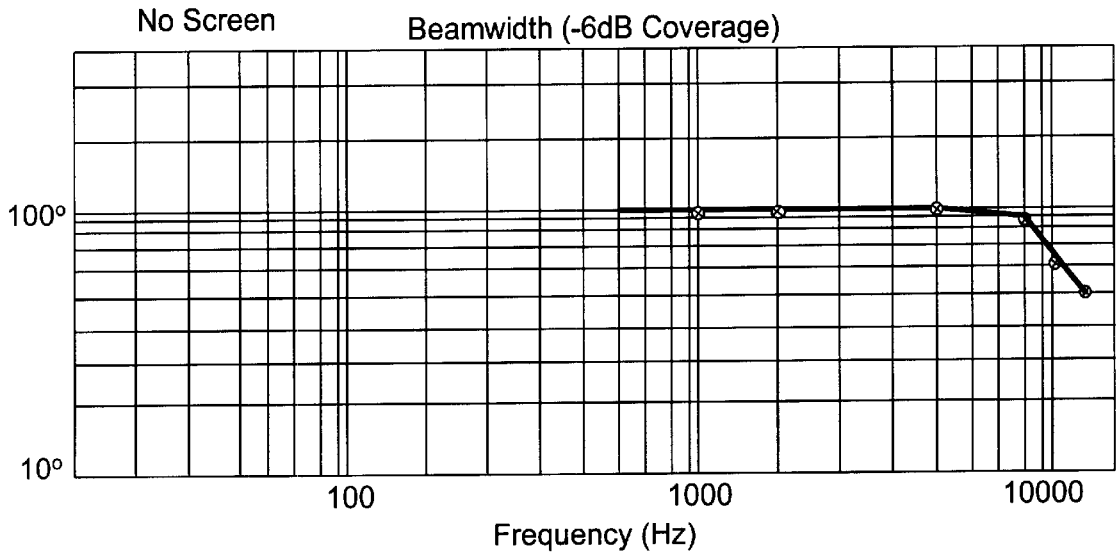
FIG. 5 is a graph showing the target frequency response of horizontal −6 dB beamwidth coverage for a high-frequency cinema loudspeaker that has been compensated for screen spreading in accordance with the present invention, assuming a free space environment with no screen present.

FIG. 5 is a graph showing the target frequency response of horizontal −6 db beamwidth for the high-frequency cinema loudspeaker of the present invention, as measured with no screen present.

Figure 6:
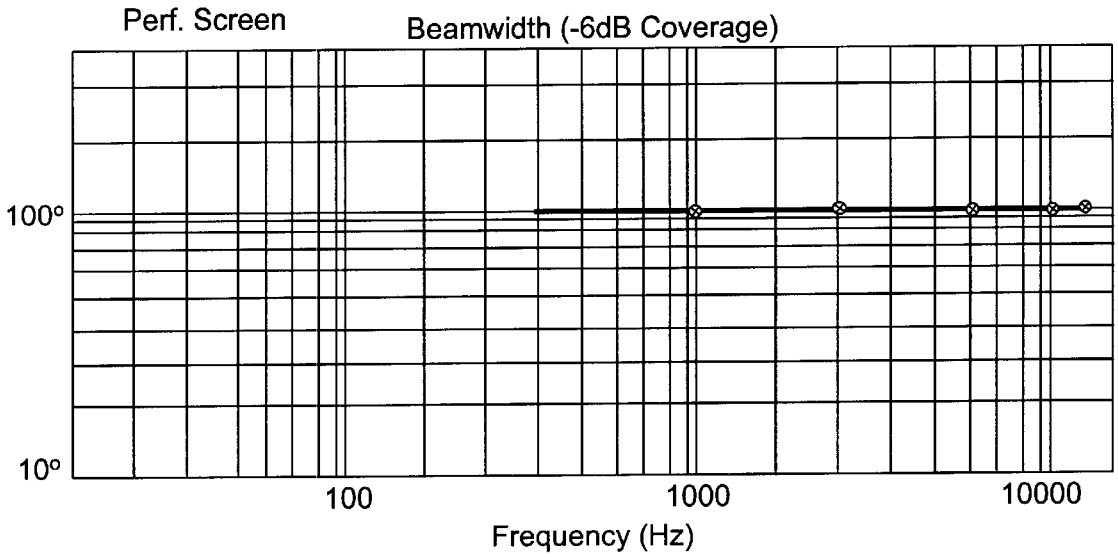
FIG. 6 is a graph showing target flat frequency response of horizontal beamwidth for the compensated high-frequency cinema loudspeaker concept of the present invention as in FIG. 5 but with the loudspeaker deployed behind a perforated cinema screen.

FIG. 6 is a graph showing the target flat frequency response of horizontal −6 dB beamwidth as in FIG. 5 but with the loudspeaker deployed behind a perforated screen.

This departure from conventional loudspeaker performance is accomplished in the present invention mainly by configuring the shape of the inside horn surface to form a waveguide that acts to reduce the beamwidth with increasing frequency as shown in FIG. 5, so that when the loudspeaker, compensated in this manner, is deployed behind a perforated screen, the beamwidth will be remain substantially constant at the desired nominal value, 100 degrees, over the full frequency range as shown in FIG. 6

Figure 7:
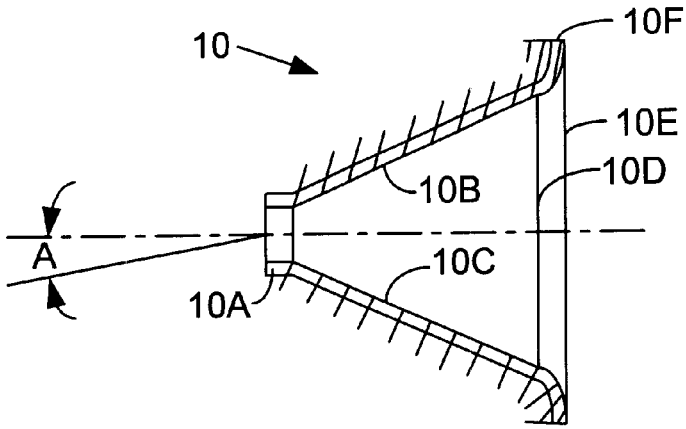
FIG. 7 is a cross-sectional side view, taken vertically through the central axis, showing the inside surfaces of the waveguide portion of a high-frequency loudspeaker embodiment of the present invention.

FIG. 7 is a cross-sectional side elevation showing the inside surface of the waveguide portion of a high-frequency loudspeaker 10 in an illustrative embodiment of the present invention, taken through the central axis. The opposing upper and lower wall surfaces 10B and 10C are configured with only a slight curvature that increases from the driven end 10A to a vertical transitional plane 10D located at approximately 90% of the total waveguide length, where the flare shape transitions in a smooth tangential manner to a greater curvature extending tangentially to the exit opening at the vertical front plane 10E of the loudspeaker 10, from which a flat surface extends vertically to the housing edge 10F.

The waveguide of high-frequency loudspeaker 10 is made vertically asymmetrical as shown so that the central axis inclines downwardly at an angle A that is made to be 5 degrees in the illustrative embodiment, as part of the overall configuration for optimal coverage.

Figure 8:
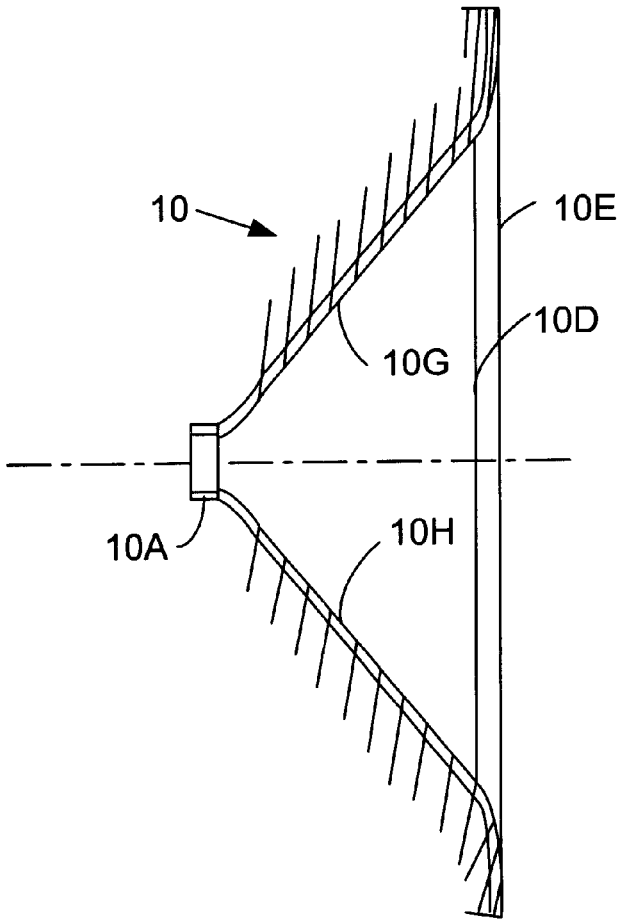
FIG. 8 is a cross-sectional top view, taken horizontally through the central axis, showing the shape of the inside surfaces of the waveguide portion of the high-frequency loudspeaker embodiment of the present invention.

FIG. 8 is a cross-sectional top view showing the inside surface of the portion of the high-frequency loudspeaker horn of the present invention as in FIGS. 5–7, taken through the central axis. The sidewall surfaces 10G and 10H are seen to be symmetrical, to flare at a wider angle and to have greater curvature than the top and bottom walls shown in FIG. 7.

Figure 9:
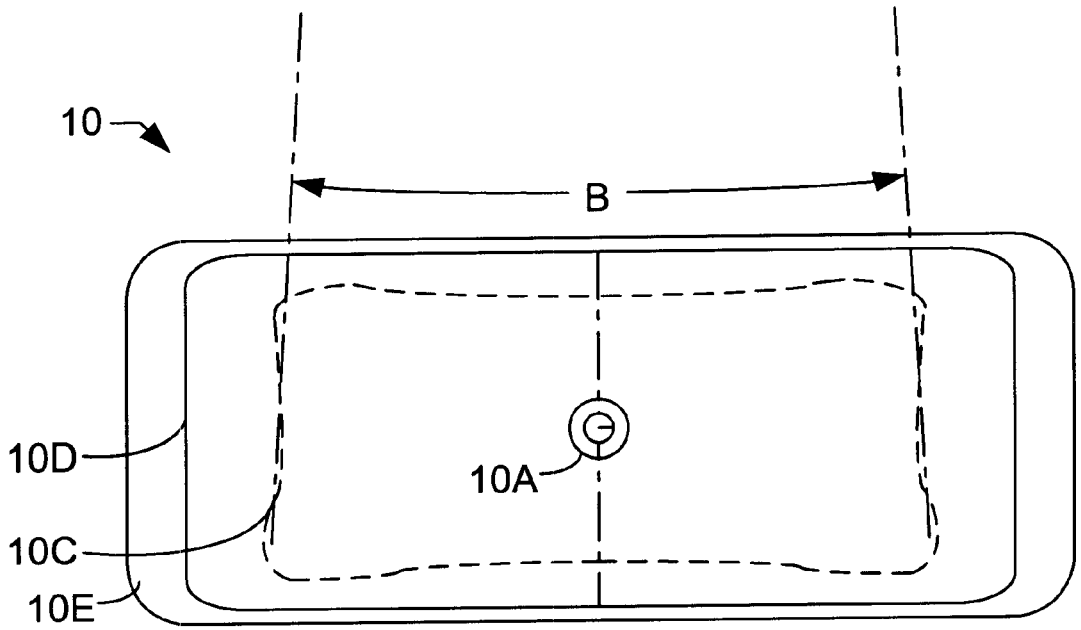
FIG. 9 is a front elevational view of the loudspeaker embodiment of FIGS. 5 and 6, showing the shape of the inside surface at the frontal plane and at a transitional plane.

FIG. 9 is a front elevational view of the loudspeaker 10 of FIG. 8 showing the cross sectional shape of the waveguide. At the driven end 10A the shape is a circle of 1" or 1.5" diameter for engaging a conventional compression driver. The waveguide shape evolves smoothly to the transitional plane 10D, where the shape is "keystone"-like with the sidewalls 10G and 10H curving inwardly as shown as well as inclining toward each other at a varying upward convergence angle B as shown, in order to contribute to the attainment of the desired overall uniform high-frequency coverage pattern.

The waveguide shape then evolves tangentially in an increased curvature in the flange region to form an exit opening that blends tangentially to vertical surfaces of the frontal plane 10E, which extend to the enclosure edges 10F.

The waveguide surfaces 10B, 10C, 10G and 10H, are shaped according to polynomial equations as shown in FIG. 10.

FIGS. 11A–C are polar graphs showing the horizontal directivity of the high-frequency loudspeaker embodiment of the present invention as in FIGS. 5 and 6, measured at 12 frequencies ranging from 1.25 kHz to 16 KHz with no screen present.

Figure 12:
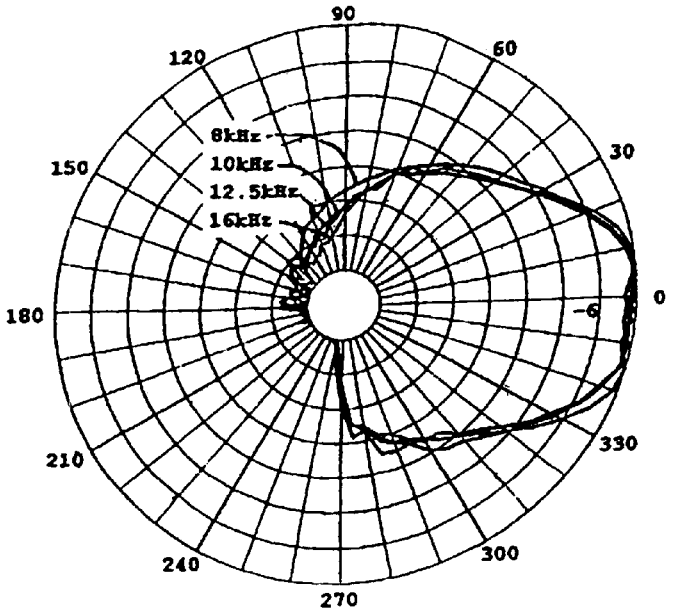
FIG. 12 is a polar graph as in FIGS. 11A–C but showing the corresponding vertical directivity at 8, 10, 12.5 and 16 kHz.

FIG. 12 is a polar graph as in FIGS. 11A–C but showing the corresponding vertical directivity at 8, 10, 12.5 and 16 kHz.

Figure 13:
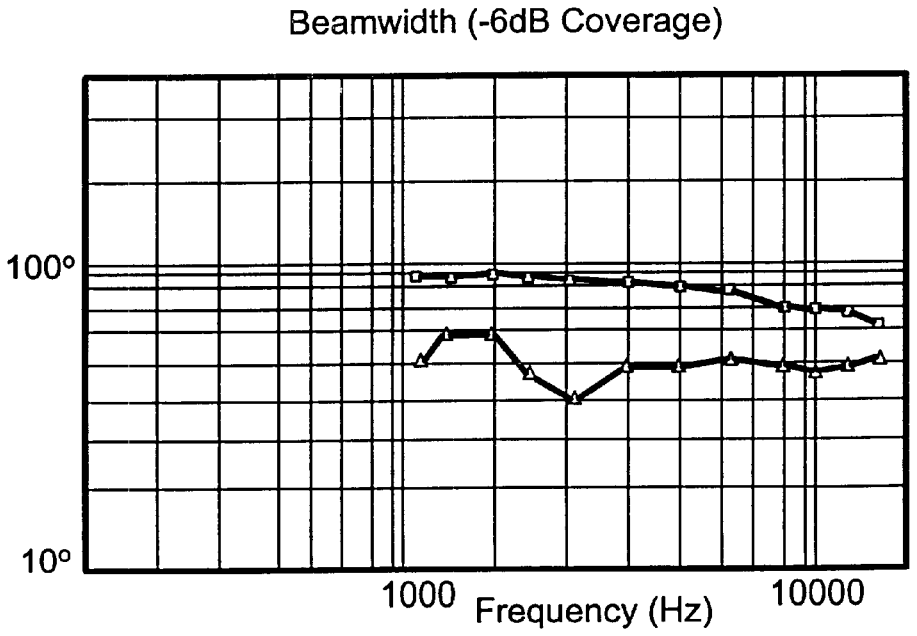
FIG. 13 is a graph showing the horizontal and vertical beamwidths of the high-frequency loudspeaker embodiment of the present invention as in FIGS. 5 and 6 with no screen present, as a function of frequency.

FIG. 13 is a graph showing the horizontal and vertical beamwidths of the high-frequency loudspeaker embodiment of the present invention as in FIGS. 5 and 6, measured at 12 frequencies ranging from 1.25 kHz to 16 KHz with no screen present. FIG. 13 shows the horizontal beamwidth to be narrowed to about 70 degrees at 10 kHz and to about 63 degrees at 16 kHz, relative to 90 degrees at 1.25 kHz, to compensate for a corresponding amount of anticipated screen spreading, so that when the loudspeaker unit is deployed behind a perforated screen, its spreading effect will increase and converge these values, bringing them up to approximately the target value of 100 degrees as shown in FIG. 6. Thus the shaping of the waveguide described above is disclosed as an illustrative embodiment that has proven successful in meeting the objectives of the invention.

The principle of the invention, i.e. compensating a loudspeaker for screen spreading at high-frequency by configuring the waveguide in a manner to narrow the beamwidth with increasing frequency, may be implemented with alternative shaping of the waveguide that may yield equivalent results The 5 degree downward inclination of the central axis as shown in the illustrative embodiment is not essential for practicing the invention: this is a refinement that may be "fine-tuned" for optimization according to particular circumstances.

Similarly the value of the upward convergence angle B (FIG. 9), the asymmetry of the upper and lower waveguide walls 10B and 10C (FIG. 7) and the symmetry of sidewalls 10G and 10H as shown in the illustrative embodiment are subject to "fine-tuning" for particular circumstances and objectives: the invention can be practiced with variations thereof.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. An improved high-frequency loudspeaker module of the compression-driven type for deployment behind a perforated cinema screen of a theater to provide uniform sound coverage across a designated high-frequency audio range in a target auditorium area of the theater, comprising:

a compression driver; and an acoustic waveguide having a sound entry end coupled acoustically and mechanically to said compression driver, said acoustic waveguide being configured internally to have a horn shape, disposed about a central axis, with a cross-sectional area that increases smoothly and progressively from the sound entry end and extending through a mid region to an enlarged flared sound exit end constituting an acoustic output port, the internal horn shape being made and arranged to provide, as measured in the absence of the perforated screen, a directivity pattern of the loudspeaker module alone that is made to decrease in beamwidth as a function of frequency within the high-frequency audio range in a manner that approximates an inverse function of beam-spreading effects of the perforated screen, so that when the loudspeaker module is deployed behind the perforated screen facing the theater auditorium target area, compensation is provided for high-frequency beam-spreading effects of the perforated cinema screen to accomplish overall an unusually high degree of uniformity in audio coverage throughout the target area.

2. The improved high-frequency loudspeaker module as defined in claim 1 wherein;

said waveguide is configured to have an internal cross-sectional shape, taken perpendicular to the central axis, that transitions from a generally circular shape at the small end to a generally horizontally-elongated rectangular shape with rounded corners through a mid region to the sound exit end; and the internal cross-sectional shape is made to increase in area from the sound entry end to the sound exit end in a manner that causes a predetermined decrease in beamwidth as a function of frequency for compensating beam spreading effects of the perforated screen.

3. The improved high-frequency loudspeaker module as defined in claim 2 wherein said acoustic waveguide is configured, oriented and arranged to create a horizontal sound directivity pattern characterized by beam width that decreases with upward projection angles above horizontal and that increases with downward projection angles below horizontal so as to enhance uniformity of sound coverage throughout the target area.

4. The improved high-frequency loudspeaker module as defined in claim 3 wherein:

said high-frequency loudspeaker module is deployed with the main axis directed at a predetermined downward angle relative to horizontal; and the sound exit end of said acoustic waveguide is configured with a peripheral front edge located in a vertical front plane for disposition behind the perforated screen, substantially parallel thereto.

5. The improved high-frequency loudspeaker module as defined in claim 4 wherein said acoustic waveguide is configured to have an internal shape characterized by:

a round cross-section taken at the sound entry end;

a transitional cross-section, taken at a transitional plane located parallel with the front plane and displaced a predetermined setback distance therefrom, that is made to be horizontally-elongated and generally rectangular in shape with rounded corners, having greater width in a bottom region thereof than in top region thereof, thus forming an inverted keystone shape resulting from the downward angle of inclination of the main axis; and a frontal cross-section, taken at the front plane, that is made to be horizontally-elongated and generally rectangular in shape with rounded corners;

said acoustic waveguide being shaped internally to transition smoothly from the sound entry end, through the transitional plane to the front plane.

6. The improved high-frequency loudspeaker module as defined in claim 1, configured and arranged to be mounted onto and deployed in conjunction with a companion loudspeaker module operating in a frequency range below the designated high-frequency audio range, as part of a total theater sound system.

* * * * *